United States Patent [19]

Ripley

[11] 4,217,990

[45] Aug. 19, 1980

[54] ADJUSTABLE HOOP CLAMP FOR TANKS OR THE LIKE

[76] Inventor: Wade D. Ripley, 2764 NW. Thurman St., Portland, Oreg. 97210

[21] Appl. No.: 11,509

[22] Filed: Feb. 12, 1979

[51] Int. Cl.[3] ..... B65D 63/08

[52] U.S. Cl. ..... 217/95; 24/284

[58] Field of Search ..... 217/95; 24/279, 280, 24/281, 284, 283

[56] References Cited

U.S. PATENT DOCUMENTS

| | | | |
|---|---|---|---|
| 477,174 | 6/1892 | Ford et al. | 217/95 |
| 759,328 | 5/1904 | Tecktonius | 217/95 |
| 1,907,889 | 5/1933 | Stauffer | 24/280 X |

FOREIGN PATENT DOCUMENTS

| | | | |
|---|---|---|---|
| 55786 | 2/1912 | Switzerland | 217/95 |

*Primary Examiner*—Allan N. Shoap
*Attorney, Agent, or Firm*—Oliver D. Olson

[57] ABSTRACT

A pair of elongated clamp blocks are joined together in laterally spaced, parallel relationship by means of a pair of vertically spaced clamp screws which serve to move the blocks toward and away from each other. Each clamp block is provided with a transverse slot extending longitudinally inward from one end thereof at an oblique angle with respect to the screws. The blocks are disposed adjacent the outer side of a tank with the slots extending angularly outward away from each other. An elongated flat strap is looped about the tank and each end portion thereof is threaded outwardly through the slot in the associated clamp block, then is bent inwardly around the inner portion of the block facing the other block of the pair, and the terminal portion of the strap end is doubled back between the looped portion of the strap and the outer surface of the tank. The screws then are rotated to draw the clamp blocks toward each other, whereby to tighten the strap about the periphery of the tank.

5 Claims, 3 Drawing Figures

ADJUSTABLE HOOP CLAMP FOR TANKS OR THE LIKE

BACKGROUND OF THE INVENTION

This invention relates to reinforcing hoops for tanks or the like, and more particularly to an adjustable hoop clamp for encircling tanks of the stave type for clamping the staves together and reinforcing the tank.

Barrels and other forms of tanks, particularly those of the stave type, utilize encircling hoops for securing the staves together and otherwise reinforcing the tank against outward stress. Such encircling loops heretofore have been of two types; namely, fixed and adjustable diameter types. The fixed diameter type of strap is used with tanks having tapering walls and are driven into compressive relationship with the wall.

The adjustable type of hoop heretofore has been made of round iron rod one end of which is secured to a cross-pull lug and the oppsite end of which is threaded and extended through the cross-pull lug for longitudinal adjustment relative thereto by means of a threaded nut. The rod becomes rusted upon exposure to the elements, thereby staining the tank and personnel who come in contact with it. The threads deteriorate to such an extent that the hoop is incapable of readjustment or removal. Moreover, the threaded end of the rod usually projects several inches from the lug and thus presents a serious hazard to personnel who may become empaled upon it.

SUMMARY OF THE INVENTION

In its basic concept, this invention provides an adjustable hoop clamp which utilizes a flat, flexible strap as the hoop and a pair of laterally adjustable, slotted clamp blocks to which the ends of the strap are removably secured.

It is by virtue of the foregoing basic concept that the principal objective of this invention is achieved; namely, to overcome the aforementioned disadvantages and limitations of prior adjustable hoop clamps.

Another object of this invention is to provide a hoop clamp of the class described which may utilize flat flexible strapping of stainless steel or other suitable material which is resistant to rusting or other corrosion.

Still another object of this invention is the provision of a hoop clamp of the class described which incorporates a pair of slotted clamp blocks of identical construction for economical manufacture, one being inverted end for end relative to the other to dispose the slots in operative position relative to the hoop strap component.

A further object of this invention is the provision of a hoop clamp of the class described which incorporates a hoop strap of any desired length for association with tanks of diverse diameters.

The foregoing and other objects and advantages of this invention will appear from the following detailed description, taken in connection with the accompanying drawing of a preferred embodiment.

DESCRIPTION OF THE PREFERRED EMBODIMENT

Figure 1:
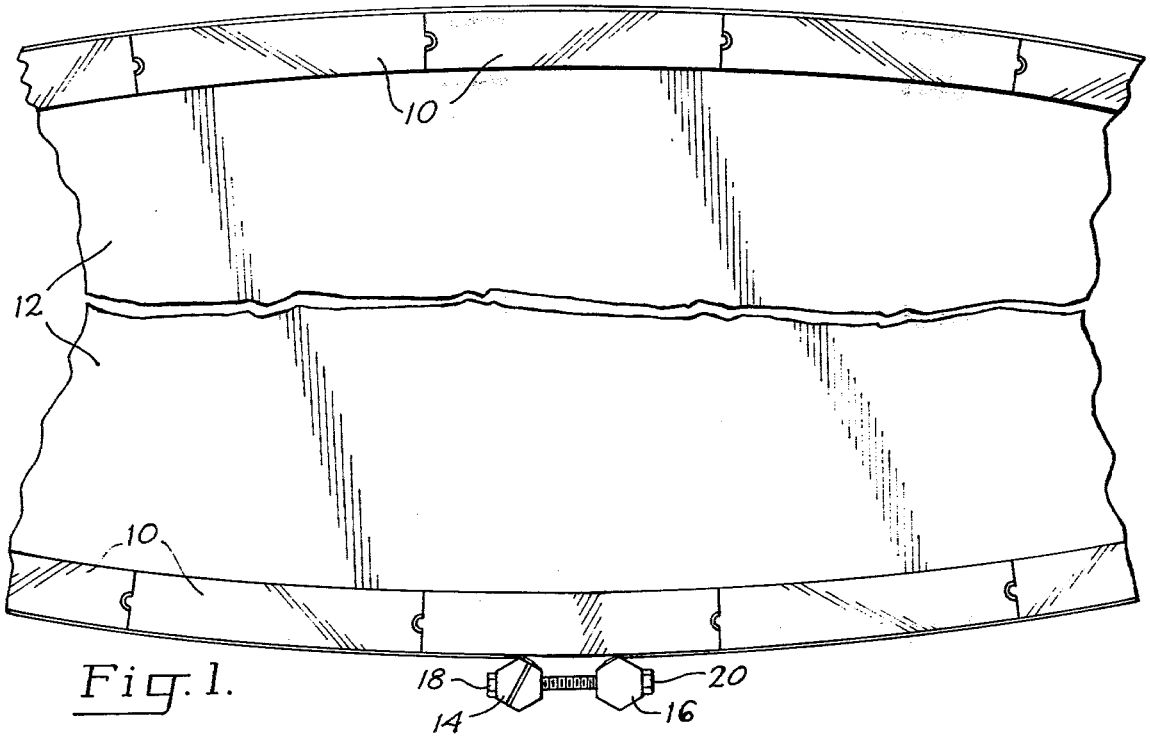
FIG. 1 is a plan view of a stave type tank having incorporated therewith an adjustable hoop clamp embodying the features of this invention.

The drawing illustrates the hoop clamp of this invention associated with a wooden tank of the stave type. It will be understood, of course, that the hoop clamp may be utilized with barrels and other forms of tanks and like containers of diverse constructions and types of materials. It has particular utility with wooden tanks of the stave type since a plurality of the hoop clamps may be utilized for clamping the staves together and reinforcing the tank against outward stress.

Thus, the drawings illustrate a plurality of wooden staves 10 of arcuate cross section and provided with tongue and groove side edges for interconnection to produce the peripheral wall of a round tank. The bottom end of the stave wall is closed by a bottom wall 12, in conventional manner.

Figure 2:
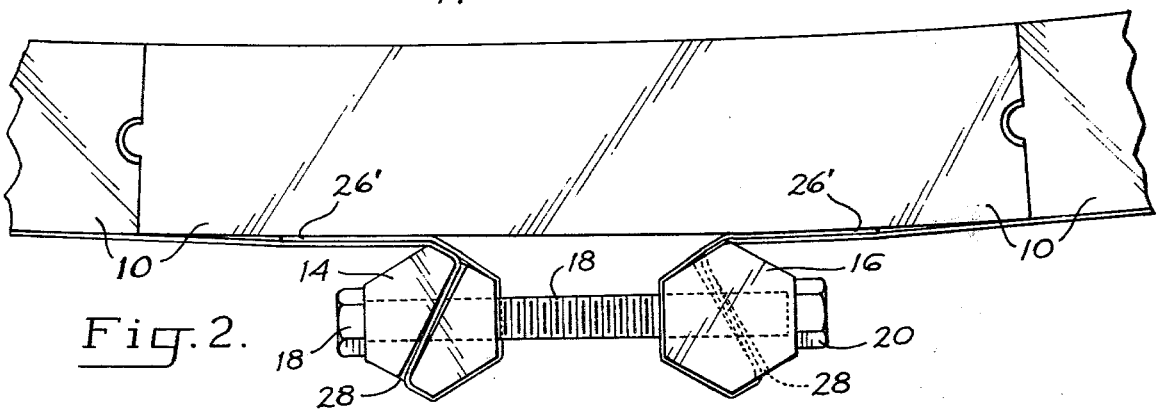
FIG. 2 is a fragmentary plan view, enlarged with respect to FIG. 1, showing details of construction and installation of the hoop clamp.
Figure 3:
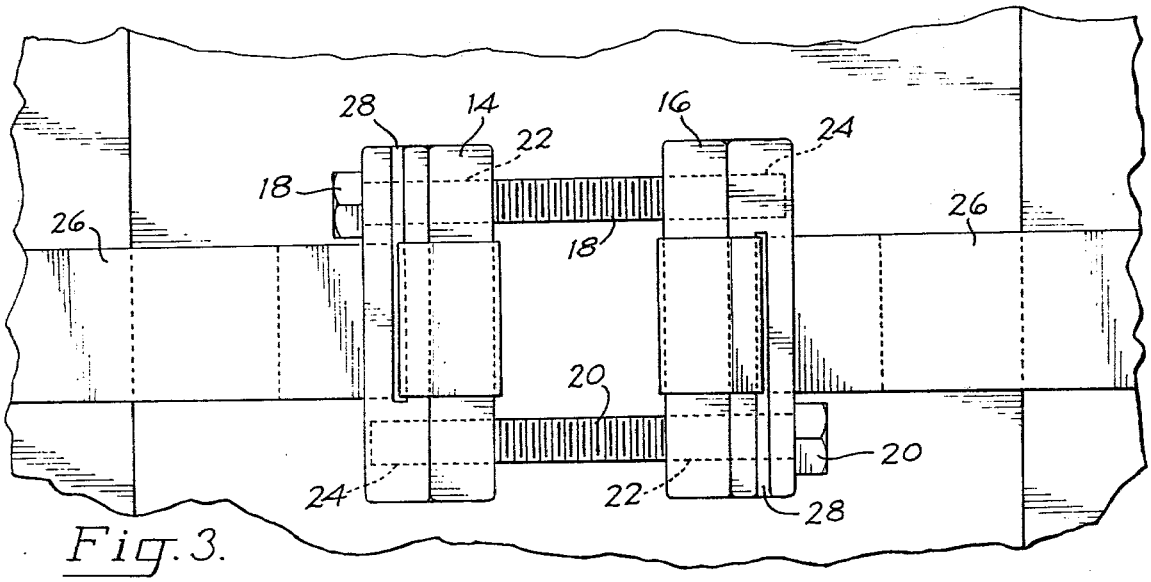
FIG. 3 is a fragmentary side elevation as viewed from the bottom in FIG. 2.

One or more adjustable hoop clamps encircle the outer side of the stave wall, at appropriate longitudinally spaced intervals, to draw the staves together and reinforce them against outward stress. FIGS. 2 and 3 of the drawing illustrate in detail the structural features of the adjustable hoop clamp of this invention.

The hoop clamp includes a pair of vertically elongated clamp blocks 14 and 16 which are secured together in side-by-side, laterally spaced relationship by means of a pair of vertically spaced, horizontally elongated clamp screws 18 and 20. As illustrated, the blocks are of hexagonal cross section and the elongated screws extend through a pair of opposed parallel sides thereof. The headed end of each screw extends through an unthreaded bore 22 in the adjacent block and the threaded terminal end portion of the screw engages a correspondingly threaded bore 24 in the opposite block.

The hoop clamp also includes an elongated flat strap 26 of flexible material capable of being formed into an open loop for encircling a tank. The strap preferably is made of stainless steel or other suitable material which is resistant to rusting and other corrosion. It also may be made of metal plated or otherwise provided with a corrosion resiatant facing. For certain types of applications, the strap may be made of flexible synthetic plastic.

Means is provided for securing the opposite end portions of the strap to the laterally spaced clamp blocks. As illustrated, each clamp block is provided with a longitudinal slot 28 extending longitudinally inward from one end of the block and terminating short of the opposite end, preferably inwardly of the adjacent clamp screw. As illustrated, the strap is narrower in width than the vertical spacing between the clamp screws and the slot extends inwardly sufficiently to position the strap centrally between the clamp screws.

It is to be noted that in the illustrated embodiment both clamp blocks are of identical construction, whereby to minimize cost of manufacture. In this regard, one of the clamp blocks is inverted end for end relative to the other clamp block. Thus, the slot extends vertically downward from the top end of the left hand block 14 and vertically upward from the bottom end of the right hand block 16. The threaded bore 24 in each block is in that portion of the block beyond the slot 28.

In the preferred embodiment illustrated in FIG. 2 of the drawing, the slot 28 in each clamp block extends between a pair of opposed parallel faces of the hexagonal shape, adjacent the pair of parallel faces through which the clamp bolts extend. Thus, the slot is disposed at an oblique angle of about 30° relative to the axes of the clamp bolts. By inverting one of the blocks end for end, as illustrated in FIG. 3, the obliquely arranged slots are capable of being disposed with the slots converging toward each other in the direction toward the strap loop, and hence toward the tank to be encircled, and to diverge away from each other in the opposite direction. This oblique arrangement of the slots contributes to securing the opposite end portions of the strap against slippage during tightening about the tank, as will now be described.

With the elongated strap 26 encircling the tank and its opposite end portions disposed adjacent but spaced apart from each other, the interconnected pair of clamp blocks are positioned adjacent the outer side of the tank with the slots 28 converging toward the tank. Each opposite end portion of the strap then is threaded through the associated slot 28 in the clamp block, between the vertically spaced clamp screws. These sections of the end portions of the strap thus diverge outwardly from the strap loop. Each end portion of the strap then is bent inward along the faces of the clamp blocks which face each other, and thence inward toward the strap loop and tank, between the vertically spaced clamp screws. The terminal end section 26' of each end portion of the strap then is slipped in between the inner surface of the strap and the outer surface of the tank. The clamp screws then are rotated to draw the clamp blocks toward each other, whereby to reduce the diameter of the strap loop and thus compress the tank staves together and reinforce the tank against outward stress.

It is desirable that the blocks be spaced apart initially a distance which allows them to be drawn together to final strap-clamping position without the screws projecting from the blocks.

It is to be observed that the bends provided in the end portions of the strap which extend through the slots and about the outer surfaces of the blocks, inhibit those portions of the straps from slipping as the clamp blocks are drawn together by the clamp screws. This resistance to slipping is further enhanced by the frictional clamping pressure exerted on the terminal end section 26' of each end portion of the strap which is sandwiched between the inner surface of the adjacent portion of the strap and the outer surface of the tank.

From the foregoing it will be appreciated that the present invention provides an adjustable hoop clamp for tanks and the like which is of simplified construction for economical manufacture and which is versatile in its application to tanks of any diameter, simply by the selection of an appropriate length of flat, flexible strap material for cooperative association with the pair of interconnected, laterally adjustable clamp blocks. The strap, clamp blocks and clamp screws may be made of corrosion resistant material. There are no projecting components of the clamp and hence the hazard of empalement is eliminated.

It will be apparent to those skilled in the art that various changes may be made in the size, shape, type, number and arrangement of parts described hereinbefore. For example, the clamp blocks may have any desired cross sectional shape other than the hexagonal shape illustrated. The strap-receiving slots in the clamp blocks may extend perpendicular to the clamp screws, although the oblique arrangement illustrated is preferred for its contribution of increased resistance to slipping of the strap as it is drawn tight about the outer periphery of the tank. These and other modifications and changes may be made, as desired, without departing from the spirit of this invention.

Having now described my invention and the manner in which it may be used, I claim:

1. An adjustable clamp for a hoop arranged to encircle the outer side of the upstanding peripheral wall of a tank or the like, comprising:

(a) a pair of elongated clamp blocks each having a longitudinal dimension, defined by opposed top and bottom ends, and a transverse dimension extending normal to the longitudinal dimension, (b) a pair of clamp screws extending through longitudinally spaced transverse openings in the pair of clamp blocks for securing the clamp blocks adjustably in longitudinally vertical, laterally spaced relation, (c) a longitudinally extending slot in each clamp block extending transversely through the block at an angle relative to the clamp screws, and (d) an elongated flat strap, (e) the strap being arranged as an open loop for encircling a peripheral wall with the opposite end portions of the strap extending radially outward relative to the encircling loop transversely through the vertically extending slots in the vertically disposed clamp blocks, thence around the vertical surfaces of the clamp blocks which face each other, inward toward the loop, and thence with the terminal end sections of the end portions extending laterally of the blocks away from each other along the inner surface of the strap adjacent the associated end portion, whereby said laterally extending terminal end sections of the strap are interposed between the strap and the outer surface of a tank or the like encircled by the loop.

2. An adjustable clamp for a hoop arranged to encircle the outer side of the upstanding peripheral wall of a tank or the like, comprising:

(a) a pair of elongated clamp blocks each having a longitudinal dimension defined by opposed top and bottom ends and a transverse dimension extending normal to the longitudinal dimension, (b) a pair of clamp screws extending through longitudinally spaced transverse openings in the pair of clamp blocks for securing the clamp blocks adjustably in longitudinally vertical, laterally spaced relation, (c) a longitudinally extending slot in each clamp block extending transversely through the block at an oblique angle relative to the clamp screws, the blocks being arranged with the slots diverging from each other in one direction and converging toward each other in the opposite direction, and (d) an elongated flat strap, (e) the strap being arranged as an open loop for encircling a peripheral wall with the opposite end portions of the strap extending radially outward relative to the encircling loop transversely through the vertically extending slots in the vertically disposed clamp blocks from the converging direction to the diverging direction of the slots, thence around the vertical surfaces of the clamp blocks which face each other, inward toward the loop, and thence with the terminal end sections of the end portions extending laterally of the blocks away from each other along the inner surface of the strap adjacent the associated end portion, whereby said laterally extending terminal end sections of the strap are interposed and gripped between the strap and the outer surface of a tank or the like encircled by the loop.

3. The hoop clamp of claim 2 wherein the pair of blocks are of substantially identical construction, the longitudinally extending slots in each clamp block extending longitudinally inward from one end of the block, the blocks being arranged longitudinally vertical with the slots extending inwardly one from the top end and the other from the bottom end, whereby to achieve said converging and diverging arrangement.

4. The hoop clamp of claim 2 wherein the clamp blocks are hexagonal in cross section, the clamp screws extend through a pair of opposed parallel sides thereof, and the slots extend through another pair of opposed parallel sides thereof.

5. An adjustable clamp for a hoop arranged to encircle the outer side of the upstanding peripheral wall of a tank or the like, comprising:

(a) a pair of elongated clamp blocks each having a longitudinal dimension defined by opposed top and bottom ends and a transverse dimension extending normal to the longitudinal dimension, (b) a pair of clamp screws extending through longitudinally spaced transverse openings in the pair of clamp blocks for securing the clamp blocks adjustably in longitudinally vertical, laterally spaced relation, (c) a longitudinally extending slot in each clamp block extending inwardly from one end of the block transversely through the block at an oblique angle relative to the clamp screws, the blocks being arranged with the slots diverging from each other in one direction and converging toward each other in the opposite direction, the blocks being arranged longitudinally vertical with one slot extending downwardly from the top end and the other slot extending upwardly from the bottom end, whereby to achieve said converging and diverging arrangement, and (d) an elongated flat strap, (e) the strap being arranged as an open loop for encircling a peripheral wall with the opposite end portions of the strap extending radially outward relative to the encircling loop transversely through the vertically extending slots in the vertically disposed clamp blocks from the converging direction to the diverging direction of the slots, the slot in each clamp block being arranged to receive the strap between the pair of clamp screws, the opposite end portions of the strap thence extending around the vertical surfaces of the clamp blocks which face each other, inward toward the loop, and thence with the terminal end sections of the end portions extending laterally of the blocks away from each other along the inner surface of the strap adjacent the associated end portion, whereby said laterally extending terminal end sections of the strap are interposed and gripped between the strap and the outer surface of a tank or the like encircled by the loop.

* * * * *